US005152421A

United States Patent [19]

Krause

[11] Patent Number: 5,152,421

[45] Date of Patent: Oct. 6, 1992

[54] BEVERAGE CAN END WITH REDUCED MATERIAL REQUIREMENTS

[76] Inventor: Arthur A. Krause, 20642 Skouras Dr., Canoga Park, Calif. 92306

[21] Appl. No.: 757,981

[22] Filed: Sep. 12, 1991

[51] Int. Cl.[5] ..... B65D 6/00

[52] U.S. Cl. ..... 220/623

[58] Field of Search ..... 220/269, 270, 271, 272, 220/273, 359, 623, 624

[56] References Cited

U.S. PATENT DOCUMENTS

| | | | |
|---|---|---|---|
| 26,524 | 2/1869 | Ronci . | |
| 3,229,847 | 1/1966 | Fox . | |
| 3,401,821 | 9/1968 | Bozek | 220/270 |
| 3,552,597 | 1/1971 | Moller | 220/270 |
| 3,774,801 | 11/1973 | Gedde . | |
| 4,333,582 | 6/1982 | Bloeck . | |
| 4,391,385 | 7/1983 | Rausing . | |
| 4,416,389 | 11/1983 | Wilkinson . | |
| 4,674,649 | 6/1987 | Pavely | 220/271 |
| 4,702,387 | 10/1987 | Wombold . | |
| 4,796,772 | 1/1989 | Nguyen . | |
| 4,832,223 | 5/1989 | Kalenak . | |

*Primary Examiner*—Stephen Marcus
*Assistant Examiner*—Nova Stucker
*Attorney, Agent, or Firm*—Dennis H. Lambert

[57] ABSTRACT

An end wall for beverage containers, in which the end wall has a center section extending across its width, and reduced thickness side sections on opposite sides of the center section, thereby enabling the end wall to be manufactured with less material than is required in conventional end wall constructions. The center section is of the same thickness as used in conventional container end walls, and is able to support a pull tab and associated pull ring, while at the same time reinforcing the end wall. The reduced thickness side sections are only about one-half as thick as the center section, and all shaping to produce the reduced thickness is performed on the top surface of the end wall, so that the underside remains flat.

20 Claims, 3 Drawing Sheets

FIG. 6
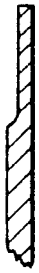
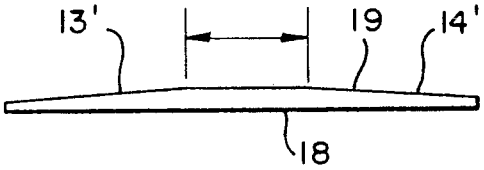
FIG. 7
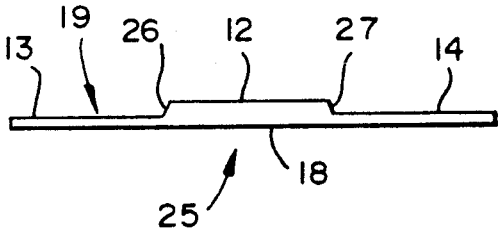
FIG. 8
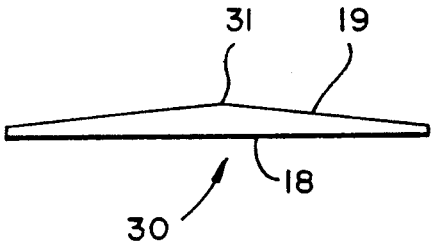
FIG. 9
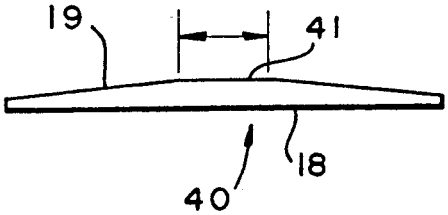
FIG. 10

BEVERAGE CAN END WITH REDUCED MATERIAL REQUIREMENTS

FIELD OF THE INVENTION

This invention relates generally to beverage containers, and more particularly, to a beverage can end which requires less material than conventional container ends.

BACKGROUND OF THE INVENTION

Containers for beverages, and especially metal containers or cans for holding carbonated beverages, are produced in large quantities, exceeding 87 billion containers per year in the United States alone. This segment of the packaging industry is therefore very competitive, and manufacturers are constantly seeking ways to improve both the performance and economy of the product.

Most such containers are manufactured from aluminum, and are openable by a pull ring riveted on the end wall, which separates a tab from the end wall along a frangible score line, forming an opening through the end wall. Those containers manufactured and used in the United States generally push the tab into the opening, leaving it attached to the container. In some countries, however, most notably Japan, the tab is pulled outwardly away from the opening, and in many cases is separated from the container.

When the containers are used for carbonated beverages, they must be engineered with adequate strength to enable the pull tab to function properly, and to withstand internal pressures which may reach in excess of 95 pounds per square inch.

One of the areas of such containers which is particularly susceptible to these high internal pressures is the end wall, or lid, of the container. Unless the end wall is of sufficient thickness, and/or engineered with proper reinforcement, it may buckle or dome under pressure. This increases the risk that the pull tab will become snagged during handling in storage and shipment, causing a leak and destroying or damaging that as well as other, adjoining containers. Moreover, buckling of the end wall may also damage or destroy the seal between the container end wall and the side wall, resulting in the carbonation being lost from the contents of the container.

In spite of these difficulties, enormous savings could be realized by reducing the amount of material used in making the containers, and efforts have been made along those lines. The container side walls, for example, have been reduced in thickness to approximately 0.005 or 0.006 inches, and the container end walls are only approximately 0.0096 to 0.012 inches thick. These dimensions have been found to be about the practical lower limit for thickness, in order to still obtain satisfactory performance. In some cases, the diameter of the container end wall has been reduced slightly in order to save material.

While such measures may seem insignificant in the context of a single container, it should be kept in mind that substantial economy can be achieved when the amount of material saved in a single container is multiplied by the enormous number of containers that are manufactured.

Other efforts have been directed toward specific engineering features, such as reinforcing ribs, or special coining operations, in order to strengthen the container end wall, but it is generally believed that the practical limit has been reached with respect to reducing the amount of material used in the construction of such containers.

A simple and economical way of saving material in beverage containers, without sacrificing performance, would represent a substantial reduction in the cost of such containers, resulting in a significant competitive advantage in this segment of the packaging industry.

SUMMARY OF THE INVENTION

Accordingly, it is a principal object of the present invention to provide a means of reducing the amount of material required in the manufacture of beverage containers, without adversely affecting performance.

A more specific object is to reduce the thickness of a beverage container end wall over all but a central, diametrically extending belt to which a pull tab is affixed in a conventional way.

To achieve this, a metal blank of conventional thickness, i.e., approximately 0.0096 inches, is rolled, pressed, or otherwise suitably formed to provide side portions whose thickness is reduced to approximately one-half the conventional thickness, but leaving a central, diametrically extending belt of the same thickness as a conventional container end wall. A score line is formed in the belt portion, and a pull ring affixed thereto in accordance with conventional technology. Appropriate conventional technology is then used to apply the end wall to a container. Depending upon the area of the reduced thickness side portions, this can result in a savings of 30% or more in the amount of material required to make the end wall.

BRIEF DESCRIPTION OF THE DRAWINGS

The foregoing, as well as other objects and advantages of the invention, will become apparent from the following detailed description when considered in conjunction with the accompanying drawings, in which like reference characters designate like parts throughout the several views, and wherein:

FIG. 6 is a transverse sectional view taken along line 6—6 in FIG. 5;

FIGS. 7-10 are end views of further forms of container end walls incorporating the reduced thickness portions according to the invention;

DETAILED DESCRIPTION OF THE PREFERRED EMBODIMENTS

Figure 1:
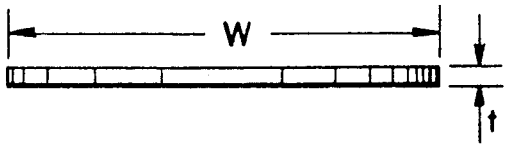
FIG. 1 is an end view of a conventional metal blank as used in producing prior art container end walls.

Referring more specifically to the drawings, a conventional metal blank, typically aluminum, is indicated generally at 10 in FIG. 1. This blank has a width W of about 2.94 inches, and a uniform thickness t of from about 0.0096 inches to about 0.012 inches. A thickness in this range has been found to be the minimum that is practical in order to achieve satisfactory performance of the pull ring and tab used on most beverage containers, and to avoid buckling and bulging of the end wall under internal pressure.

Figure 2:
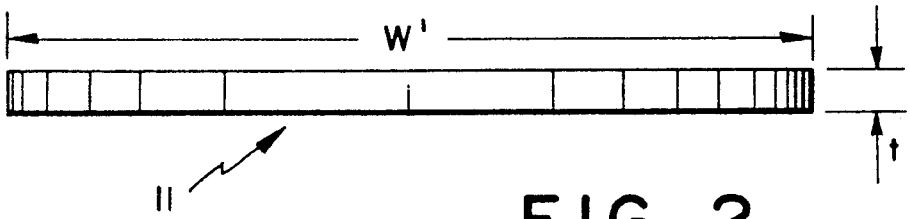
FIG. 2 is an end view of a metal blank as used in producing a container end wall in accordance with the present invention.

In FIG. 2, a blank as used in producing an end wall in accordance with the invention is indicated generally at 11. As represented in this figure, the blank starts with the same uniform thickness as a conventional blank, i.e., from about 0.0096 inches to about 0.12 inches, and may have a width W' of from ten inches to fourteen inches, or even fifty-eight to sixty inches.

Figure 4:
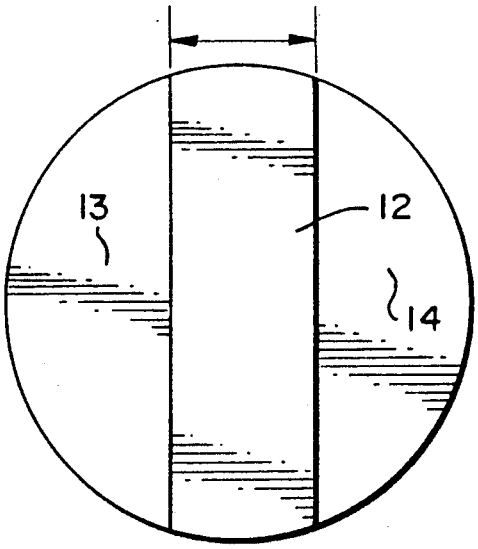
FIG. 4 is a plan view of a completed blank according to a first form of the invention as used in producing a container end wall.

Following a three step rolling process, the blank has a diametrically extending belt 12 of the same thickness t as the starting blank, i.e., from about 0.0096 inches to about 0.012 inches, and a width w of about 0.70 to 1.25 inches. The belt in this form of the invention extends completely across the end wall, from one edge to the other, as shown in FIG. 4. The remaining side portions or chords 13 and 14 of the end wall, however, have been reduced to a thickness t' that is only approximately one-half the thickness of the belt, i.e., about 0.005 inches. This construction enables a pull tab and associated pull ring to be affixed to the center section, since it is of the same thickness as conventional end walls. At the same time, the center section or belt reinforces the thinner end wall, preventing buckling under internal pressure.

Figure 11:
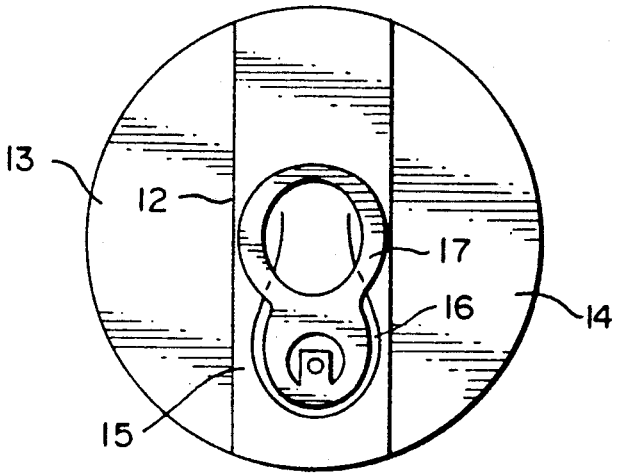
FIG. 11 is a plan view of a completed end wall structure, having a pull tab formed in the thicker belt portion, and a pull ring attached thereto.

A score line 15 is formed in the belt portion 12, defining a pull tab 16 to which a pull ring 17 is attached, all in accordance with conventional technology. The completed end wall structure, as shown in FIG. 11, is then assembled to a container side wall in accordance with well known techniques.

It will be noted that the underside 18 of the end wall structure in all of the forms of the invention described herein is planar, as in conventional constructions, and the top surface 19 is shaped to form the reduced thickness portions.

Figure 3:
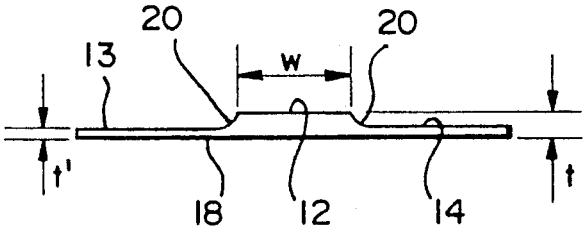
FIG. 3 is an end view of a partially formed blank used in the production of a container end wall in accordance with the invention.

As shown in FIG. 3, the transition from the belt to the reduced thickness side portions is radiused, as at 20, with the side portions 13 and 14 being of uniform thickness throughout.

In FIG. 7, the reduced thickness side portions 13' and 14' taper gradually from the opposite side edges of the belt to the outer edge of the end wall structure, thus varying in thickness from 0.0096 inches at the belt, to 0.006 inches at the perimeter of the end wall. The belt in this form of the invention is about 0.875 inches wide.

The end wall structure 25 shown in FIG. 8 is similar to that shown in FIG. 3, except that the transition from the belt 12 to the reduced thickness side portions 13 and 14 comprises straight steps or shoulders 26 and 27. The belt in this form of the invention has the same width as in the previous forms.

In the end wall structure 30 of FIG. 9, there is no definite belt. Rather, the end wall is left with the original thickness, i.e., 0.0096 inches, at a central spine 31 extending completely across the width of the end wall, and the thickness of the end wall is tapered from this spine to a thickness at the outer margin of only about 0.006 inches.

The container end wall structure 40 shown in FIG. 10 is similar to that shown in FIG. 7, except that the belt 41 is narrower, having a width W" of only about 0.750 to about 0.875 inches.

Figure 5:
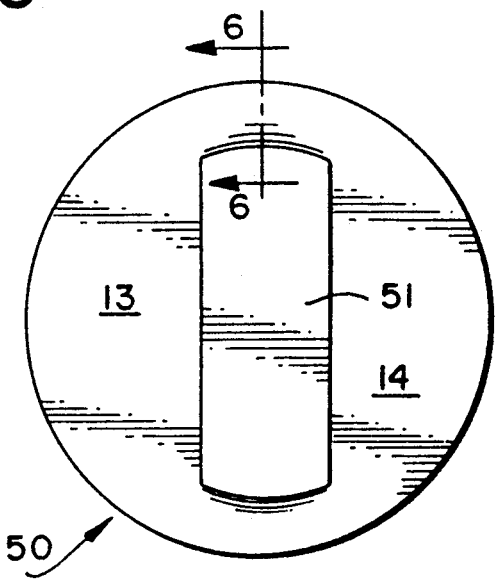
FIG. 5 is a plan view of a completed blank according to a second form of the invention as used in producing a container end wall.

A further variation is shown in FIG. 5, wherein the end wall structure 50 is subjected to a further rolling or pressing operation to reduce the thickness of the opposite end portions of the belt 51 to the same thickness as the reduced thickness side portions 13 and 14. This configuration may lend itself more readily to attachment to the container side wall by conventional methods.

Figure 12:
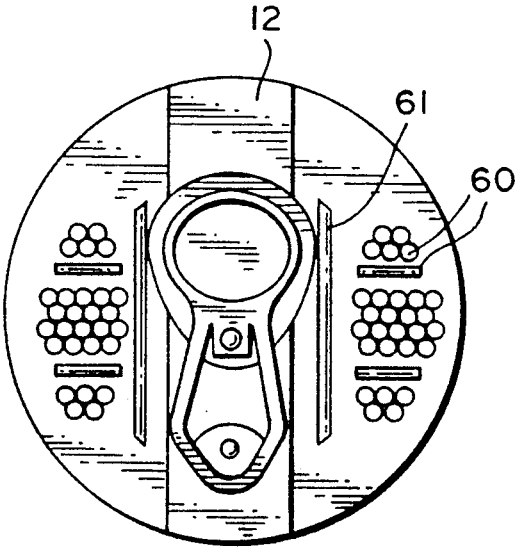
FIG. 12 is a plan view of a completed end wall structure, shown attached to a container side wall, and showing various reinforcing means that may be incorporated therein.

In FIG. 12, a variety of reinforcing configurations 60, 61 are formed in the reduced thickness side portions of the container end wall. These may comprise vertical folds, channels, or indicia such as company logo, etc., or other means known in the art. The reinforcing configurations may be depressed or raised, as desired, and may be U-shaped or V-shaped in cross-section, or have another shape in transverse cross-section, as desired. In a typical example, they would have a depth of from about 0.03125 inches to about 0.0625 inches.

Figure 13:
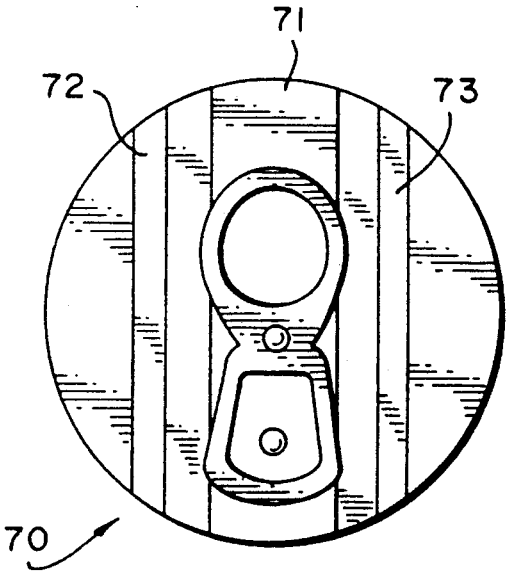
FIG. 13 is a plan view similar to FIG. 12, showing a further form of reinforcing means that may be incorporated in the end wall.

The container end wall 70 shown in FIG. 13 is reinforced by a plurality of narrow belts 72 and 73 extending across the end wall parallel to the center belt 71. These reinforcing belts may have any of the configurations shown in FIGS. 3 and 7–10, or any other suitable cross-sectional shape. As shown in this figure, there is only one reinforcing belt on each side of the main, center belt, but more than one reinforcing belt could be provided on each side of the center belt, if desired. The reinforcing belts could be formed at the same time that the center belt is being formed.

While the invention has been illustrated and described in detail herein, it is to be understood that various changes in construction may be made without departing from the spirit and scope of the invention, as defined in the appended claims.

What is claimed is:

1. A beverage container end wall that requires less material in its manufacture than conventional beverage container end walls, said container end wall having a center and outer edges;

the material of said end wall being formed with a belt-like first portion having a first thickness adapted to operatively support a pull tab and pull ring and extending across the width of the end wall at the center thereof, and second portions on opposite sides of the first portion, extending from the first portion to the outer edges of the end wall, said belt-like first portion serving to reinforce said end wall to prevent doming thereof under pressure from the contents of the container, and said second portions having a second thickness less than the first thickness, thereby reducing the amount of material required in the construction of the end wall; and said first portion and said second portions being unitarially formed of the same material; and means on the first portion defining a separable pull tab having a pull ring to remove the pull tab to form an opening through the end wall.

2. A beverage container end wall as claimed in claim 1, wherein:

said container end wall is circular in plan view, and said first portion extends along a diameter of the end wall.

3. A beverage container end wall as claimed in claim 2, wherein:

said first portion has a length extending completely across the width of the end wall, and has a width that is less than one-half its length, forming a belt extending across the end wall.

4. A beverage container end wall as claimed in claim 3, wherein:

the reduced thickness second portions are of uniform thickness and are joined to the belt by transition sections.

5. A beverage container end wall as claimed in claim 4, wherein:

the transition sections comprise radiused shoulders leading from the belt to the reduced thickness second portions.

6. A beverage container end wall as claimed in claim 4, wherein:

the transition sections comprise straight, angled shoulders leading from the belt to the reduced thickness second portions.

7. A beverage container end wall as claimed in claim 3, wherein:

the reduced thickness second portions slope gradually downwardly from opposite sides of the first portion to the opposite outer edges of the end wall.

8. A beverage container end wall as claimed in claim 2, wherein:

the reduced thickness second portions slope gradually downwardly from opposite sides of the first portion to the opposite outer edges of the end wall.

9. A beverage container end wall as claimed in claim 1, wherein:

opposite end portions of the belt are reduced in thickness to the same thickness as the second portions, thereby facilitating attachment to a container side wall.

10. A beverage container end wall as claimed in claim 1, wherein:

reinforcing configurations are formed in said reduced thickness second portions to strengthen them.

11. A beverage container end wall as claimed in claim 10, wherein:

said container end wall is circular in plan view, and said first portion extends along a diameter of the end wall.

12. A beverage container end wall as claimed in claim 11, wherein:

said first portion has a length extending completely across the width of the end wall, and has a width that is less than one-half its length, forming a belt extending across the end wall.

13. A beverage container end wall as claimed in claim 12, wherein:

the reduced thickness second portions are of uniform thickness and are joined to the belt by transition sections.

14. A beverage container end wall as claimed in claim 13, wherein:

the transition sections comprise radiused shoulders leading from the belt to the reduced thickness second portions.

15. A beverage container end wall as claimed in claim 13, wherein:

the transition sections comprise straight, angled shoulders leading from the belt to the reduced thickness second portions.

16. A beverage container end wall as claimed in claim 11, wherein:

the reduced thickness second portions slope gradually downwardly from opposite sides of the first portion to the opposite outer edges of the end wall.

17. A beverage container end wall as claimed in claim 11, wherein:

opposite end portions of the belt are reduced in thickness to the same thickness as the second portions, thereby facilitating attachment to a container side wall.

18. A beverage container end wall as claimed in claim 16, wherein:

the underside of said end wall is substantially flat and planar.

19. A beverage container end wall as claimed in claim 10, wherein:

said reinforcing configurations comprise narrow belts of increased thickness relative to said second portions, extending across the width of the end wall parallel to the first portion.

20. In a beverage container having a metal end wall, and a tear tab on the end wall for forming an opening through the end wall, the improvement comprising:

a first portion of the end wall having a first thickness adapted to operatively support the tear tab; and second portions of the end wall on opposite sides of the first portion having reduced thickness relative to the first portion, so that said first portion defines a belt extending substantially along a diameter of the end wall, said belt serving to reinforce said end wall to prevent doming thereof under pressure from within the container and also providing structure on which to mount the tear tab for conventional operation, and the reduced thickness sections enable substantially less material to be used in the construction of the end wall than in conventional end walls.

* * * * *